United States Patent [19]

Palma

[11] 4,423,841

[45] Jan. 3, 1984

[54] ELECTROMAGNETIC FUEL INJECTOR WITH PIVOTABLE ARMATURE STOP

[75] Inventor: James D. Palma, Grand Rapids, Mich.

[73] Assignee: General Motors Corporation, Detroit, Mich.

[21] Appl. No.: 351,963

[22] Filed: Feb. 24, 1982

Related U.S. Application Data

[63] Continuation-in-part of Ser. No. 343,431, Jan. 28, 1982.

[51] Int. Cl.[3] ..... F02M 51/06

[52] U.S. Cl. ..... 239/585; 251/129; 251/141

[58] Field of Search ..... 239/584, 585, 600; 251/129, 141

[56] References Cited

U.S. PATENT DOCUMENTS

| | | | |
|---|---|---|---|
| 2,639,193 | 5/1953 | Wood, Jr. | 239/584 |
| 3,434,667 | 3/1969 | Chmura | 239/584 |
| 3,738,578 | 6/1973 | Farrell | 239/585 |
| 3,797,756 | 3/1974 | Voit et al. | 239/585 |
| 4,218,021 | 8/1980 | Palma | 239/585 |
| 4,247,052 | 1/1981 | Gray | 239/585 |

*Primary Examiner*—John J. Love
*Assistant Examiner*—Michael J. Forman
*Attorney, Agent, or Firm*—Arthur N. Krein

[57] ABSTRACT

An electromagnetic fuel injector includes an armature stop member, providing a flat surface with the lower body portion being of semi-spherical configuration, which is pivotably positioned in a conforming ball socket provided in the free end of an armature so that the flat surface extends outboard of the armature whereby it can abut against an associate pole piece to provide for a fixed minimum air gap between the pole piece and armature. In the event of any slight skewness between the axis of the pole piece and the reciprocating axis of the armature, the armature stop member will pivot, as necessary, to effect parallelism of the flat surface thereof with the flat working surface of the pole piece.

4 Claims, 1 Drawing Figure

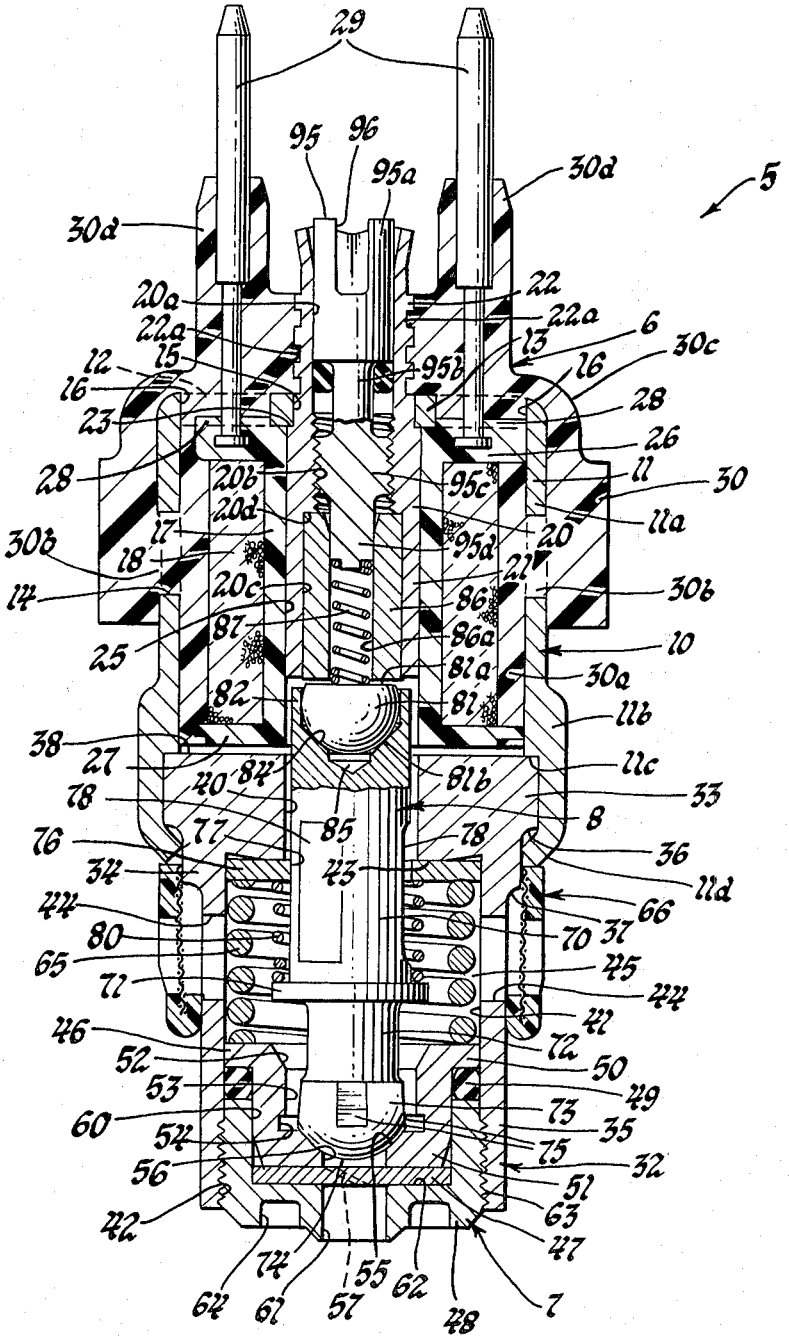
29
95
96
95a
30d
30d
5
20a
22
22a
22a
6
13
30c
12
15
95b
16
16
28
23
26
28
20b
95c
11
30
20d
11a
17
95d
20
30b
18
21
14
20c
86
30b
87
86a
10
25
81a
30a
82
81
11b
38
27
84
81b
11c
78
20
33
8
76
77
85
78
36
34
43
11d
44
66
80
70
37
65
45
71
44
41
46
72
52
50
53
49
60
73
54
35
56
75
32
51
42
63
47
74
55
62
64
61
57
48
7

ELECTROMAGNETIC FUEL INJECTOR WITH PIVOTABLE ARMATURE STOP

FIELD OF THE INVENTION

This invention relates to electromagnetic fuel injectors and, in particular, to an armature and armature stop structure for use in such injectors.

This application is a continuation-in-part of copending U.S. patent application Ser. No. 343,431 filed Jan. 28, 1982 and assigned to the assignee of the present invention.

DESCRIPTION OF THE PRIOR ART

Various types of electromagnetic fuel injectors are known in the art. Normally such injectors contain a solenoid assembly that includes an electromagnetic coil which, when energized, is operative to effect axial movement of an armature. Normally the armature, which is operatively associated with a valve movable relative to a valve seat for controlling fuel injection, is slidably received and guided by its outer peripheral surface in a guide bore in the housing of the injector.

Such injectors normally require very close manufacturing tolerances to obtain substantial concentricity of parts, to obtain proper stroke length of the armature/-valve combination relative to the pole piece of the solenoid assembly, and to obtain other desired structural relationships effecting fuel metering, and the durability of the injector.

However, in order to provide for adequate response time of such an injector, the armature of the solenoid assembly in the injector is usually made of a suitable magnetically soft material. Magnetically soft materials are used since they provide high permeability and typically low residual magnetism. Unfortunately, such magnetically soft materials are generally also correspondingly physically soft, the materials normally being annealed for optimized magnetic properties.

Because of this, the armatures in the known prior art injectors are subject to excessive wear during extended use, as would occur in a motor vehicle fuel injection system. Such wear thus negates the previously obtained close manufacturing tolerances of the armature relative to the remaining associated elements of the injector and, accordingly, detrimentally affecting the overall operation, including the fuel metering function, of the injector.

SUMMARY OF THE INVENTION

A primary object of the present invention is to provide an improved electromagnetic fuel injector construction that uses a truncated ball-like stop member, having a flat surface on its upper side with the lower portion being of semi-spherical configuration, that is pivotably received in ball socket provided in the free end of the armature member of unit whereby the flat surface upon engagement with the working face of an associate pole piece can be automatically aligned for planar engagement with the pole piece.

Another object of the invention is to provide an improved armature assembly for use in an electromagnetic fuel injector, the armature assembly including an armature having a ball socket therein and a truncated ball-like stop member pivotably received in the ball socket.

The present invention provides an electromagnetic fuel injector, the movable element of which is an armature/valve member having a semi-spherical valve member at one end thereof and a cylindrical armature at its opposite end, the latter being provided with a central ball socket therein in its free end. The armature is spring-biased towards a valve-closed position and is drawn against the spring bias toward an associate pole piece by current flow in the solenoid. A hardened, truncated ball-like stop member is pivotably positioned in the ball socket so that it will be the member which operatively engages the pole piece as the armature is drawn thereto, the stop member being free to automatically pivot as necessary to effect full face operational contact with the pole piece. The ball-like stop member is also used to provide a minimum fixed air gap between the actual opposed working surfaces of the pole piece and armature.

For a better understanding of the invention as well as other features thereof, reference is had to the following detailed description to be read in connection with the accompanying drawing.

DESCRIPTION OF THE FIGURE

The FIGURE is a longitudinal cross-sectional view of a preferred embodiment of an electromagnetic fuel injector having an armature stop in accordance with the invention incorporated therein, the armature/valve member of the injector being shown partly in elevation.

DESCRIPTION OF THE EMBODIMENT

Referring to the FIGURE, the embodiment of the electromagnetic fuel injector, generally designated 5, illustrated therein includes, as major components thereof, a solenoid assembly 6, a nozzle assembly 7 and an armature/valve member 8.

The solenoid assembly 6 is similar in both its construction and in its method of manufacture to that disclosed in the above-identified United States patent application Ser. No. 343,431, the disclosure of which is incorporated herein by reference thereto.

In the construction illustrated, the solenoid assembly 6 includes a stamped, cup-shaped, solenoid housing 10, made for example, of SAE 1008–1010 steel, having a rim-like, circular body 11 and an integral flange 12 extending radially inward from the upper end of body 11 portion. Body 11 is provided with a plurality of circumferentially spaced apart apertures 14 located intermediate its ends. In the construction shown, body portion 11 includes an upper portion **11*a* and a lower portion 11*b*, the latter having both a greater internal diameter and a greater external diameter than the respective diameters of upper portion 11*a*. A flat shoulder 11*c* interconnects upper and lower portions 11*a* and 11*b***, respectively.

The flange 12 is provided with a central aperture 15 extending axially therethrough. Flange 12 is also provided with a plurality of through apertures 16, only two such apertures being seen in the FIGURE, that are circumferentially equally spaced apart and located radially outward of central aperture 15. Preferably, at least two diametrially opposite apertures 16 are of arcuate configuration for a purpose also to be described in detail hereafter.

Solenoid assembly 6 further includes a cylindrical, tubular pole piece 20 and a spool-like, tubular bobbin 17 supporting a wound wire solenoid coil 18.

In the construction illustrated, the pole piece 20 is provided with a cylindrical lower portion 21 of predetermined diameter, a cylindrical upper portion 22 of a reduced diameter corresponding to the internal diameter of aperture 15 and an interconnecting flat shoulder 23.

In addition, the pole piece 20 is preferably provided with a stepped bore therethrough which, starting from the top with reference to the FIGURE, defines an internal circular upper bore wall 20*a*, an intermediate internally threaded wall 20*b*, and a lower straight bore wall 20*c*, with the threaded wall 20*b* being of reduced internal diameter relative to the internal diameters of walls 20*a* and 20*c*. The walls 20*b* and 20*c* are interconnected by a shoulder 20*d*.

The pole piece 20 is fixed to the solenoid housing as by having the portion 22 of the pole piece 20 extending in press fit through the bore, with its shoulder 23 in abutment against the flange 12 next adjacent to bore 15. In addition, the outer peripheral surface of the upper portion 22 of the pole piece 20 is provided with a plurality of axial spaced apart annular grooves or recessed portions 22*a*. An associated encapsulant member 30, to be described in detail hereinafter, has portions thereof projecting into the lower grooves 22*a* whereby to further effect axial retention of the pole piece 20.

The bobbin 17, made of a suitable plastic material, such as glass filled nylon, is provided with a central through bore 25 of a diameter to receive the lower portion 21 of pole piece 20, as by a press fit, whereby the bobbin 17 is supported concentrically within the solenoid housing 10 and with the upper flange 26 thereof in abutment against the inside surface of the flange portion 12 of the solenoid housing 10.

The upper flange 26 and bottom flange 27 of bobbin 17 each has a circular main flange body portion with a plurality of circumferentially spaced apart lobes extending radially outward therefrom so that, when these flanges are loosely received by the interior surface of wall 11*a* of the solenoid housing 10, a suitable radial clearance will exist at least between the outer peripheral edge of the main flange body portions and wall 11*a* to receive the material of an encapsulant member 30, to be described in detail hereinafter.

Bobbin 17 is also provided with a pair of diametrically opposed upright terminal leads 29, which project upward from bobbin flange 26 and from the opposed upstanding bosses 28 thereon so as to project centrally up through the pair of arcuate shaped apertures 16 in the solenoid housing 10 for connection to a suitable controlled source of electrical power, as desired. The opposite end of each such lead 29 is suitably connected, in a known manner, to a terminal end of the solenoid coil 18.

Preferably, the axial extent of bobbin 17 is preselected relative to the internal axial extent of the body 11*a* portion of the solenoid housing between the lower surface of flange 12 and the shoulder 11*c* so that, when the bobbin 17 is positioned in the solenoid housing 10, as shown in the FIGURE, an axial clearance will exist between the lower face of the bottom flange 27 of the bobbin 17 and the shoulder 11*c* of the solenoid housing 10, for a purpose to be described hereinafter.

Bobbin 17 is further supported within the solenoid housing 10 by means of an encapsulant member 30, made of a suitable encapsulant material, such as glass filled nylon, that includes a cylindrical portion 30*a* encircling the solenoid coil 18 and the outer peripheral edge of the lower flange 27 of the bobbin 17 and which is also in abutment against the inner surface of the upper portion 11*a* of body 11; a plurality of radial or axial extending bridge connectors 30*b* connecting in number to the apertures 14 and 16, respectively; an outer cup-shaped outer shell 30*c* encircling the exterior upper portion 11*a* of body 11 and flange 12, including the boss 13 thereof, of the solenoid body 10; and, a pair of diametrically opposed studs 30*d*, each of which encloses a terminal lead 29.

Preferably, as shown, the encapsulant material of outer shell 30*c* and of studs 30*d* extends into engagement with a predetermined axial portion of the upper portion 22 of pole piece 20 and into the grooves 22*a* thereof to entrap the pole piece while still permitting the upper end thereof to project outward of the encapsulant material.

As shown in the FIGURE, the flange 27 of bobbin 17 is preferably undercut at its lower outer peripheral edge to effect a lock with the cylindrical portion 30*a* of the encapsulant member 30 so as to further effect positive retention of the bobbin 17 within the solenoid housing 10.

Referring now to the nozzle assembly 7, it includes a nozzle body 32, of tubular configuration, having a circular upper portion 33, a circular intermediate portion 34 and a circular lower portion 35. Portions 34 and 35 are of successively reduced external diameters relative to the external diameter of upper portion 33. Portions 33 and 34 are interconnected by an external shoulder 36 and portions 34 and 35 are interconnected by an external shoulder 37.

The nozzle body 32 is fixed to the solenoid housing 10, with the outer peripheral edge portion of the flat upper surface 38 of the nozzle body 32 in abutment against shoulder 11*c*, as by inwardly crimping or swaging the lower end of body portion 11*b* at a location next adjacent to shoulder 36 to define a radially inward extending rim flange 11*d*.

Since as previously described, the axial extent of bobbin 17 is preselected to provide an axial clearance between its lower surface and the shoulder 11*c*, the nozzle body 32 can abut against the shoulder 11*c*. In addition, because of the increased rate of thermal expansion of the material of the bobbin 17 relative to the material of the solenoid housing 10, a sufficient clearance is thus provided for such expansion so that the bobbin will not press against the nozzle body 32.

Nozzle body 32 is provided with a central through stepped bore to provide an internal circular upper wall 40 and a lower wall 41. Wall 41 is of a greater internal diameter than that of wall 40 and is provided at its lower end with internal threads 42. The walls 40 and 41 are interconnected by a flat shoulder 43 undercut next adjacent wall 41.

In addition, the nozzle body 32 is provided with a plurality of circumferentially spaced apart radial ports 44 in the lower portion 35 thereof which open into a fuel chamber 45 defined in part by the lower wall 41.

The nozzle assembly 7 further includes a valve seat element 46, a director plate 47 and a spray tip 48 with a seal ring 49 positioned between the valve seat element 46 and spray tip 48, in a manner to be described hereinafter.

Valve seat element 46 is provided with an upper flange 50 and with a reduced diameter body 51 depending therefrom the latter being preferably tapered at its lower end, as shown, to effect its assembly into spray tip 48. A stepped central bore through the valve seat element 46 defines, in succession, starting from the top with reference to the FIGURE, an internal conical upper wall 52, an internal straight guide wall 53, an annular recess 54, a conical valve seat 55 and a lower wall defining a discharge passage 56.

The director plate 47 is provided with a plurality of circumferentially, equally spaced apart inclined and axial extending director passages 57. Preferably six such passages are used, although only one such passage is shown in the FIGURE. These director passages 57, of predetermined equal diameters, extend at one end downward from the upward surface of the director plate 47 and are positioned so that their upper ends are located radially inward of the discharge passage 56 in the valve seat element 46.

The spray tip 48, of cup-shaped configuration, is provided with a circular internal upper wall 60 and a reduced diameter lower wall 61 that defines a passage for the discharge of fuel from the nozzle assembly. The walls 60 and 61 are interconnected by a flat shoulder 62.

As illustrated, the upper wall 61 of the spray tip 48 is of a suitable internal diameter whereby to slidably receive the body 51 portion of the valve seat element 46 and to receive the director plate 47. As shown, the director plate 47 is positioned so that it is sandwiched between the lower end surface of the valve seat element 46 and the internal shoulder 62 of the spray tip. Also as shown, the ring seal 49 is located so as to encircle the reduced diameter body 51 of the valve seat element 46 whereby it will be sandwiched between it and the internal wall 41 of the nozzle body 32.

In the construction shown, the outer peripheral surface of the spray tip 48 is provided with external threads 63 for mating engagement with the internal threads 42 of the nozzle body 32. Preferably these mating threads are of a suitable fine pitch whereby to limit axial movement of the spray tip a predetermined extent, as desired, for each full revolution of the spray tip 48 relative to the nozzle body 32.

The lower face of the spray tip 48 is provided, for example, with at least a pair of diametrically opposed blind bores 64 of a size so as to slidably receive the lug of a suitable spanner wrench, not shown. With this arrangement rotational torque may thus be applied to the spray tip 48 during assembly of the element of the nozzle body 32 and to effect axial adjustment of this element in the nozzle body 32 during flow calibration of the injector in a known manner, as described for example, in U.S. Pat. No. 4,218,021 Palma, entitled "Electromagnetic Fuel Injector".

As illustrated, a coil spring 65 is loosely positioned in the fuel chamber 45 whereby the upper end thereof abuts against a guide washer 76, to be described hereinafter, which in turn abuts against shoulder 43. The opposite or lower end of spring 65 abuts against the upper flange 50 surface of the valve seat element 46 whereby the valve seat element is biased into abutment against the spray tip 48, with the director plate 47 sandwiched therebetween.

To effect filtering of the fuel being supplied to the injector 5 prior to its entry into the fuel chamber 45, there is provided a fuel filter assembly, generally designated 66. The fuel filter assembly 66 is adapted to be suitably secured, as by a suitable press fit, to the nozzle body 32 in position to encircle the radial ports 44.

Referring now to the armature/valve member 8, this member, starting in succession from the top with reference to the FIGURE, includes an armature 70, an outward extending radial flange 71 a stud portion 72 and a valve 73. The armature 70 is of circular configuration and of a predetermined outside diameter whereby it is loosely reciprocable in both the bobbin bore 25 and in the wall 40 of the bobbin 17 and nozzle body 32, respectively.

As shown, the valve 73 is of semi-spherical configuration and of a predetermined radius whereby it is slidably received and guided by the guide wall 53 of the valve seat element 46 and whereby its spherical lower end defines a seating surface 74 for engagement with the valve seat 55. As illustrated, at least two, and preferably more suitable flats 75 are provided on the outer peripheral side surface of the valve 73, that is about its horizontal centerline, with reference to the FIGURE, whereby each flat defines a passage with the guide wall 53 for the flow of fuel. In the embodiment illustrated, for such flats 75 are provided on the valve 73 in circumferentially, equally spaced apart relationship to each other.

To further effect axial guiding of the armature/valve member 8 during axial movement between a lowered position, as shown in the FIGURE, whereat valve 73 engages the valve seat 55 and, a raised position, the armature/valve member 8 is guided intermediate its ends by means of a guide member, in the form of a relatively thin guide washer 76, that is positioned in the fuel chamber 45 cavity within the nozzle body 32.

The guide washer 76 has a central aperture therethrough defining a straight internal guide wall 77 of a predetermined internal diameter relative to the outside diameter of the armature 70 whereby it will slidably receive this armature 70 portion of the armature/valve member 8 intermediate its ends. The outside diameter of the guide washer 76 is preselected relative to the internal diameter of the wall 41 of the nozzle body 32 so as to be relatively loosely received therein for positioning against the shoulder 43 thereof.

As illustrated, suitable circumferentially spaced apart flats 78 are provided on the outer peripheral surface of the armature 70 at an axial location whereby to define with the guide wall 77 of the guide washer 76 suitable passage of the flow of fuel. In the construction illustrated, three such flats 78 are provided on the armature 70.

As shown, the guide washer 76, as thus loosely received in wall 41 is held in abutment against the shoulder 43 of the nozzle body 32 by the coil spring 65.

With the arrangement shown, the armature/valve member 8 is guided at one end by the valve 73 slidable in the guide wall 53 of the valve seat element 46 and, intermediate its ends by the armature 70 in the guide wall 77 of guide washer 76 so that the armature will not engage either the internal wall defined by bore 25 in bobbin 17 nor the wall 40 in the nozzle body 32.

However, by the use at one end of the armature/-valve member 8 of a ball-like valve guided in the interior wall guide portion of the valve seat element 46 and by the intermediate use of the guide washer 76 loosely received in bore wall 41, it will be apparent that the armature/valve member 8 will be suitably guided for reciprocating movement along an axis which may be slightly skewed relative to the axis of the pole piece 20.

In the preferred embodiment illustrated, the armature/valve member 8 is normally biased in an axial direction, downward with reference to the FIGURE, to the position shown, so that the valve 73 is in seating engagement with valve seat 55 by an armature spring return means which includes a coiled armature return spring 80 of predetermined force and a trim spring 87.

As illustrated, the armature return spring 80 is positioned to loosely encircle armature 70 with one end thereof in abutment against the flange 71 of the armature/valve member 8 and its opposite end in abutment against the guide washer 76.

When the armature/valve member 8 is in its lowered position as shown in the FIGURE, a working air gap is established between the lower end of the pole piece 20 and the upper end of the armature 70 by axial positioning of the spray tip 48 in the nozzle body 32.

However, in order to provide for a minimum fixed working air gap between the lower end of the pole piece 20 and the upper end of the armature, when in its raised position, and in order to compensate for any skewness between the axis of the pole piece and the axis of movement of the armature, there is provided in accordance with the invention a ball-like, armature stop member 81 that is pivotably positioned in a ball socket 82 provided for this purpose in the upper free end of the solenoid 70 portion of the armature/valve member 8.

In the construction illustrated, the ball socket 82 is defined by a circular internal guide wall of an internal diameter so as to slidably receive the armature stop member 81, a radially inward extending, conical guide stop seat 84 and, a small diameter blind bore wall 85.

As illustrated, the armature stop member 81 is of truncated ball-like configuration to provide a flat surface 81*a* at its upper end for a purpose to be described, the lower surface portion 81*b* thereof being of semi-spherical configuration for pivotable movement within the ball socket 82 while engaged with the conical guide stop seat 84 therein.

Preferably and as illustrated, the armature stop member 81 as thus positioned so as to abut against the guide stop seat 84 has the upper flat surface 81*a* thereof extending outboard of the upper working surface of the armature 70 a preselected distance as desired for operative abutment against the opposed working surface of the associate pole piece 20.

Preferably a solenoid stop 86 in the form of a hollow tubular plug is suitably fixed, as by a press fit, in the bore wall 20*c* portion of the pole piece 20. As shown, the solenoid stop 86 extends axially into the pole piece 20 from the lower end thereof so as to abut against the internal shoulder 20*d*. Preferably, the axial extent of the solenoid stop 86 is preselected relative to the axial extent of bore wall 20*c* so that the lower end thereof projects downward from the lower end face of the pole piece a predetermined distance, as desired. The lower end face of the solenoid stop 86 is thus operative, in cooperation with the armature stop member 81, so as to limit upward movement of the armature toward the lower working face of the pole piece 20 whereby to establish a minimum fixed working air gap between the opposed working surfaces of the pole piece and armature.

Preferably both the armature stop member 81 and the solenoid stop 86 are made of a suitable physically hard material so as to reduce the wear on these elements during repeated contact with each other.

It will now be apparent that with the armature stop member 81 and ball socket 82 arrangement shown, the armature stop member 81 can pivot, as required, to allow the flat surface 81*a* thereof to achieve full contact with the flat face at the lower free end of the solenoid stop 86, or with the working face of the pole piece 20 if such solenoid stop 86 is not used, during upward travel of the armature/valve member 8 upon energization of the solenoid coil 18. This arrangement thus prevents armature face and solenoid stop or pole piece face edge or point contact as a result of slight variation in centerline axes parallelism, as a result of slight skewness of the axes of travel of the armature/valve member 8 relative to the axes of the pole piece 20.

Referring now again to the trim spring 87, this spring is positioned, in the construction shown, so that its force can be adjusted, as desired through an internally accessible adjusting means. For this purpose, the trim spring 87 is loosely received in the bore 86*a* in the solenoid stop 86 whereby the lower end of this spring will abut against the upper flat surface of the armature stop member 81. The opposite end of the trim spring is positioned so as to abut against the lower end of an externally accessible adjustment screw 95.

The adjustment screw 95 in the construction illustrated includes a head 95*a*, or a diameter to be slidably received in the bore wall 20*a* of the pole piece 20, a shank depending from the head with the shank including a reduced diameter shank portion 95*b*, an externally threaded screw portion 95*c* threadingly engaged with the internally threaded wall 20*b* of the pole piece and, a lower abutment portion 95*d* of a diameter so that it is slidably received in the bore 86*a* of the solenoid stop. As shown, the abutment portion 95*d* terminates at an abutment surface and a centering pin portion for the upper end of the trim spring 87.

As illustrated, the head 95*a* of the adjustment screw 95 is provided with a suitable internal drive recess, for example, a screwdriver slot 96, whereby the screw can be rotated, as desired, to effect axial displacement thereof in either an up or down direction, as desired, with reference to the FIGURE, whereby the force of the trim spring 87 can be varied as desired.

After final adjustment of the bias force of the trim spring 87 suitable means can be used to prevent rotation of the adjustment screw relative to the pole piece. For example and in accordance with the embodiment illustrated, the upper end portion 22 of the pole piece 20 can be forced radially inward into the cavity of the screw slot 96 so as to prevent rotation of this screw relative to the pole piece.

The embodiments of the invention in which an exclusive property or privilege is claimed are defined as follows:

1. An electromagnetic fuel injection valve including a housing means defining a generally cylindrical bore terminating at one end in a fuel discharge passage means located at a spray tip end of the housing means; a solenoid pole piece means extending into said bore and being fixed at one end to said housing means so as to extend at its free end axially within said housing a predetermined axial extent, said solenoid pole piece means having a flat stop surface at its free end; an armature means operatively associated with a valve member at one end thereof operatively positioned in said bore for movement in valve opening and closing directions to open and close the fuel discharge passage means, the opposite end of said armature means having a central ball socket therein; said solenoid pole piece means including a solenoid coil to effect movement of said armature means in one direction upon energization of said coil; and an armature stop member having a flat surface on one end thereof and being spherical opposite said flat surface, said armature stop member being pivotally positioned in said ball socket with said flat surface thereof extending outwardly of said armature means a predetermined distance for engagement with said pole piece means to limit travel of said armature means in a valve opening direction, said pivot member being pivotable as required to achieve full contact of said flat surface with said flat stop surface of said solenoid pole piece due to slight variation of centerline parallelism between said solenoid pole piece and said armature means.

2. An electromagnetic fuel injection valve including a housing means defining a generally cylindrical bore terminating at one end in a fuel discharge passage means located at a spray tip end of the housing means; a solenoid pole piece extending into said bore and being fixed at one end to said housing means so as to have its free end extend axially within said housing means a predetermined axial extent, a solenoid stop means fixed to said solenoid pole piece and having a flat stop surface at its free end parallel to the free end surface of said pole piece; an armature means operatively associated with a valve member operatively positioned in said bore for movement in valve opening and closing directions to open and close the fuel discharge passage means, the opposite end of said armture means having a central ball socket therein; said solenoid pole piece including a solenoid coil to effect movement of said armature means in one direction upon energization of said coil; and an armature stop member having a flat surface on one end thereof and being spherical opposite said flat surface pivotally positioned in said ball socket with said flat surface thereof extending outwardly of said armature means a predetermined extent for engagement with said solenoid stop means whereby to limit travel of said armature means in a valve opening direction, said pivot member being pivotable as required to achieve full contact of said flat surface with said flat stop surface of solenoid stop means due to slight variation of centerline parallelism between said solenoid pole piece and said armature means.

3. An electromagnetic fuel injection valve including a housing means defining a generally cylindrical bore terminating at one end in a fuel discharge passage means located at a spray tip end of the housing means; a tubular hollow solenoid pole piece extending into said bore and being fixed at one end to said housing means so as to extend axially within said housing a predetermined axial extent, a tubular solenoid stop means fixed at one end in said pole piece and having a flat stop surface at its free end extending outboard of said pole piece; an armature means having a valve member associated therewith operatively positioned in said bore for movement in valve opening and closing directions to open and close the fuel discharge passage means, the opposite end of said armature means having a central ball socket therein; said solenoid pole piece including a solenoid coil to effect movement of said armature means in one direction upon energization of said solenoid coil; and a pivot member having a flat surface on one end thereof and being spherical opposite said flat surface pivotally positioned in said ball socket with said flat surface thereof extending outwardly of said armature means a predetermined extent for engagement with said solenoid stop means to limit travel of said armature means in a valve opening direction, said pivot member thus being pivotable as required to achieve full contact of said flat surface with said flat stop surface of said solenoid stop means due to slight variation of centerline parallelism between said solenoid pole piece and said armature means.

4. An electromagnetic fuel injection valve including a housing means defining a generally cylindrical bore terminating at one end in a fuel discharge passage means located at a spray tip end of the housing means; a solenoid pole piece extending into said bore and being fixed at one end to said housing means so as to extend axially within said housing a predetermined axial extent and having a partly threaded bore extending therethrough, a tubular solenoid stop means fixed at one end in said bore in said pole piece and having a flat stop surface at its free end extending outboard of said pole piece; an armature means operatively associated with a valve member at one end thereof operatively positioned in said bore for movement in valve opening and closing directions to open and close the fuel discharge passage means, the opposite end of said armature means having a central ball socket therein; said solenoid pole piece including a solenoid coil to effect movement of said armature means in one direction upon energization of said solenoid coil; a spring means positioned in said housing means and operatively connected to said armature means to normally bias said armature means in a valve closing direction; a pivot member having a flat surface on one end thereof and being spherical opposite said flat surface pivotally positioned in said ball socket with said flat surface thereof extending outwardly of said armature means a predetermined distance for engagement with said solenoid stop means to limit travel of said armature means in a valve opening direction, said pivot member being pivotable as required to achieve full contact of said flat surface with said flat stop surface of said solenoid stop means due to slight variation of centerline parallelism between said solenoid pole piece and said armature means; said spring means including a trim spring positioned in said solenoid stop means with one end thereof in abutment against said flat surface of said stop member; and, an adjustment screw threaded into said solenoid pole piece for operative engagement with the opposite end of said spring.

* * * * *